United States Patent [19]

Karakida et al.

[11] Patent Number: 4,965,154

[45] Date of Patent: Oct. 23, 1990

[54] ELECTROPHOTOGRAPHIC PHOTORECEPTOR HAVING SURFACE LAYERS

[75] Inventors: Kenichi Karakida; Shigeru Yagi; Yuzuru Fukuda; Masayuki Nishikawa; Te Nam Roh; Noriyoshi Takahashi; Masato Ono, all of Kanagawa, Japan

[73] Assignee: Fuji Xerox Co., Ltd., Tokyo, Japan

[21] Appl. No.: 368,103

[22] Filed: Jun. 19, 1989

Related U.S. Application Data

[63] Continuation of Ser. No. 61,969, Jun. 15, 1987, abandoned.

[30] Foreign Application Priority Data

Jun. 16, 1986 [JP] Japan ..... 61-138176
Jun. 16, 1989 [JP] Japan ..... 61-138177

[51] Int. Cl.[5] ..... G03G 5/082
[52] U.S. Cl. ..... 430/58; 430/65; 430/84; 430/95

[58] Field of Search ..... 430/57, 66, 84, 58, 430/65

[56] References Cited

U.S. PATENT DOCUMENTS 4,600,671 7/1986 Saitoh et al. ..... 430/84
4,663,258 5/1987 Pai et al. ..... 430/66

*Primary Examiner*—John L. Goodrow
*Attorney, Agent, or Firm*—Finnegan, Henderson, Farabow, Garrett, and Dunner

[57] ABSTRACT

An electrophotographic photoreceptor comprising a photoconductive layer, a first surface layer and a second surface layer formed in sequence on a support, said photoconductive layer being substantially composed of amorphous silicon, and each of said first and second surface layers being substantially composed of nitrogen-doped amorphous silicon, the concentration of nitrogen atoms in the second surface layer being higher than that in the first surface layer. The photoconductive layer is doped with atoms of an element of group III, or in at least a part of the photoconductive layer doped with germanium atoms in place of the element of group III.

13 Claims, 1 Drawing Sheet

ELECTROPHOTOGRAPHIC PHOTORECEPTOR HAVING SURFACE LAYERS

This application is a continuation of application Ser. No. 07/061,969, filed June 15, 1987 now abandoned.

BACKGROUND OF THE INVENTION

1. Filed of the Invention:

The present invention relates to a photoreceptor for electrophotography that contains amorphous silicon.

2. Prior Art:

The life of a photoreceptor for use in electrophotography is known to be chiefly governed by such factors as the deterioration of its electrical properties, the occurrence of flaws on its surface, and the changes (especially the thermal change) in the properties of the materials of which the photoreceptor is made. Photoreceptors made of amorphous silicon based materials have recently been the subject of intensive studies by many researchers because it is anticipated that such materials will be completely free from the restraints of the various factors that have governed the life of conventional photoreceptors. In other words, since amorphous silicon materials retains stable electrical characteristics over cyclic use, have high hardness, and are thermally stable, they have the potential to provide an extremely long-lived photoreceptor.

Beside its potential for extending the life of photoreceptors, amorphous silicon has a high photosensitivity in the range of longer wavelength than conventional materials and its sensitivity can be further extended into the range of still longer wavelength by selecting an appropriate formulation. Therefore, photoreceptors made of amorphous silicon can be used with printers that employ small and low-cost semiconductor lasers as light sources.

In spite of these advantages that increase its potential for use as the material of a photoreceptor, amorphous silicon has its own problems in practice in terms of dark resistance, photosensitivity at long wavelengths, mechanical strength properties (in particular, ductility), time-dependent stability, and dependency of image quality on environmental factors (i.e., temperature and humidity).

Amorphous silicon materials have high hardness (their Vickers hardness is on the order of $10^3$) but if they are brought into contact with less hard materials (e.g. the edge of copying paper and the cleaning blade in a copying machine), the area of contact will fail to produce an image and remain as white dots. It is also known that a photoreceptor made of amorphous silicon experiences a reduced resolution (i.e., dilation) if it is cyclically used for fairly long period in a copying machine (or printer). This is probably due to the deposition of foreign matter on the surface of the photoreceptor and/or to the change in the properties of the photoreceptor. The phenomenon of dilation can also materialize for reasons associated with the structure of the photoreceptor (e.g. use of an inappropriate surface layer) and if this is the case, the phenomenon will occur in the initial period of use, that is, within a few cycles to several tens of cycles of operation.

SUMMARY OF THE INVENTION

The present invention has been accomplished in order to solve the aforementioned problems of conventional amorphous silicon based photoreceptors.

An object, therefore, of the present invention is to provide a photoreceptor for electrophotography that produces an initial image of high quality and which exhibits a higher time-dependent stability and a longer run.

Another object of the present invention is to provide a photoreceptor for electrophotography that has a high dark resistivity and enables efficient initial charging.

Still another object of the present invention is to provide a photoreceptor for electrophotography that retains high photosensitivity over the full spectrum range of visible light and up to the near-infrared region in which semiconductor lasers are designed to operate.

A further object of the present invention is to provide a photoreceptor for electrophotography whose characteristics depend little on the environment in which it is used.

A still further object of the present invention is to provide a photoreceptor for electrophotography that produces a stable and high-quality initial image under all environmental conditions of use and which will not deteriorate as a result of cyclic use.

These objects of the present invention can be attained by an electrophotography photoreceptor that has a photoconductive layer, a first surface layer and a second surface layer formed in sequence on a support, said photoconductive layer being substantially composed of amorphous silicon, and each of said first and second surface layers being substantially composed of nitrogen-doped amorphous silicon, the concentration of nitrogen atoms in the second surface layer being higher than that in the first surface layer.

The objects of the present invention can be attained more efficiently by incorporating 0.1–100 ppm of atoms of an element of group III in the photoconductive layer, or by incorporating germanium atoms at least in part of said photoconductive layer.

The advantages of the present invention will be attained in an even more effective manner by providing between the support and the photoconductive layer a charge injection blocking layer that is composed of amorphous silicon doped with 10–5,000 ppm of atoms of an element of group III or V.

DETAILED DESCRIPTION OF THE INVENTION

Figure 1:
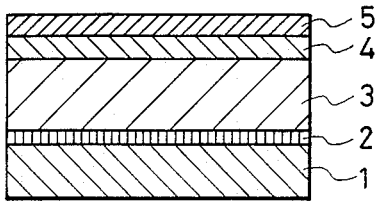
FIGS. 1 to 3 are diagrammatic cross sections of electrophotographic photoreceptors according to three embodiments of the present invention.

The electrophotographic photoreceptor of the present invention is hereinafter described in detail with reference to the accompanying drawings. FIG. 1 is a diagrammatic cross section of the photoreceptor according to a typical embodiment of the invention. In the figure, 1 is a support, 2 is a charge injection blocking layer, 3 is a photosensitive layer, and 4 and 5 are first and second surface layers, respectively. The charge injection blocking layer 2 is made of amorphous silicon doped with atoms of an element of group III or V. The dopant is present in an amount which preferably ranges from 10 to 5,000 ppm, more preferably from 50 to 1,000 ppm. The photoconductive layer 3 is made of amorphous silicon doped with 0.1–100 ppm of atoms of an element of group III, or doped with in at least part of the photoconductive layer germanium atoms in place of the atoms of an element of group III. Atoms of an element of group III are preferably incorporated in an amount of 0.5–50 ppm. Each of the surface layers 4 and 5 is made of amorphous silicon doped with nitrogen atoms which are present in a higher concentration in the second surface layer 5 than in the first surface layer 4.

The support 1 may be formed of any material selected from among metals such as aluminum, nickel, chromium and stainless steel, and plastic sheets, glass and paper that are provided with an electrically conductive film. A suitable material may be selected according to the specific object of use.

Each of the charge injection blocking layer, the photoconductive layer, and the first and second surface layers is substantially composed of amorphous silicon and can be formed by any suitable technique such as glow discharge decomposition, sputtering, ion plating or vacuum evaporation. Production of these layers by glow discharge decomposition may proceed as follows: the feed gas is a mixture of a principal starting gas containing the necessary dopant atoms; if desired, the mixture may contain a carrier gas such as a hydrogen gas or an inert gas; if film formation is to be effected by ac discharge, the conditions to be employed may be a frequency of 50 Hz –50 GHz, a pressure in the reactor of $10^{-4}$–5 Torr, and a discharge power of 10–2,000 W; the support is heated at a temperature of 30°–300° C. Each of the layers can be formed in varying thicknesses by controlling the duration of discharge. The principal starting gas containing silicon atoms is typically a silane, specifically $SiH_4$ and/or $Si_2H_6$.

The charge injection blocking layer 2 is made of amorphous silicon doped with atoms of an element of group III or V. The dopant is preferably present in an amount of 10–5,000 ppm. The blocking layer 2 preferably has a thickness of 0.01–5 μm. Whether dopant atoms should be selected from elements of group III or from elements of group V depends on the sign of the electrical charges to be deposited on the photoreceptor. The layer 2 is formed either with a feed gas containing atoms of an element of group III, which is typically diborane ($B_2H_6$), or with a feed gas containing atoms of an element of group V, which is typically phosphine ($PH_3$). In addition to elements of group III or V, the charge injection blocking layer which is substantially made of amorphous silicon may contain other elements for attaining various purposes.

The photoconductive layer 3 is made of amorphous silicon doped with 0.1–100 ppm of atoms of an element of group III. If desired, at least part of this layer may be doped with germanium atoms in place of atoms of an element of group III. In either case, the region of the layer that is doped with atoms of an element of group III desirably has a thickness of 1–100 μm. In forming the layer 3, if a feed gas containing germanium atoms is employed, it may be of any substance that contains germanium and which can be used in a vapor phase. A typical example is a germane ($GeH_4$). Diborane is typically used as a feed gas containing atoms of an element of group III. The amorphous silicon based photoconductive layer may contain various elements in addition to elements of group III and germanium depending upon the specific object of use.

Figure 2:
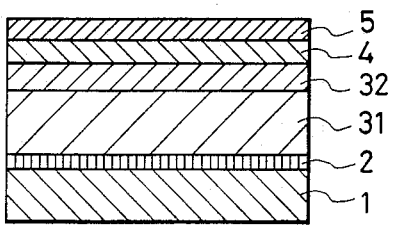
Figure 3:
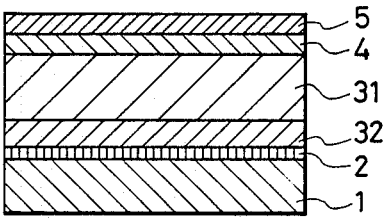

The effectiveness of the photoconductive layer 3 can be enhanced by allowing different functions to be fulfilled by two different layers, a charge generation layer and a charge transport layer, as shown in FIGS. 2 and 3. The charge transport layer 31 is substantially composed of amorphous silicon doped with atoms of an element of group III. The thickness of this layer is preferably within the range of 1–100 μm. The feed gas containing atoms of an element of group III which is used in forming the layer 31 is typically diborane. The concentration of the atoms of an element of group III is preferably within the range of 0.1–100 ppm. The charge generating layer 32 is substantially composed of amorphous silicon doped with germanium atoms. This layer preferably has a thickness of 0.1–10 μm. The preferable concentration of germanium atoms to be incorporated in the layer 32 is within the range of 0.1–1.5 in terms of the ratio of the number of gerumanium atoms to that of silicon atoms.

Because the atoms mentioned above, the amorphous silicon based photoconductive layer 3 or each of its constituent layers 31 and 32 may contain atoms of various elements depending upon the specific object of use.

Each of the surface layers 4 and 5 is substantially composed of nitrogen-doped amorphous silicon. The feed gas containing nitrogen atoms which is to be employed in forming these layers may be of any substance composed of nitrogen or any nitrogenous compound that can be used in a vapor phase and suitable examples are $N_2$ gas or gases of hydrogenated nitrogen compounds such as $NH_3$, $N_2H_4$ and $HN_3$. The nitrogen-containing feed gas used in the formation of the first surface layer 4 may be the same or different from the feed gas used in the formation of the second surface layer 5. It should, however, be noted that the concentration of nitrogen atoms in the second surface layer 5 must be higher than that in the first surface layer 4. In addition to nitrogen atoms, each of the amorphous silicon based first and second surface layers 4 and 5 may contain other elements for attaining various purposes.

The concentration of nitrogen atoms in the first surface layer 4 is preferably within the range of 0.1–1.0 in terms of the ratio of the number of nitrogen atoms to that of silicon atoms. The thickness of this layer is desirably within the range of 0.01–5 μm. The concentration of nitrogen atoms in the second surface layer 5 is preferably within the range of 0.5–1.3 in terms of the ratio of the number of nitrogen atoms to that of silicon atoms. The thickness of this layer is desirably within the range of 0.01–5 μm.

The photoreceptor of the present invention may be used in any electrophotographic process but particularly good results will be attained when it is used in a process that involves its being heated to a surface temperature of at least 35°–50° C. In such a process, the photoreceptor of the present invention will produce a stable and high-quality initial image under any environmental conditions without experiencing any image deterioration as a result of cyclic use.

Figure 4:
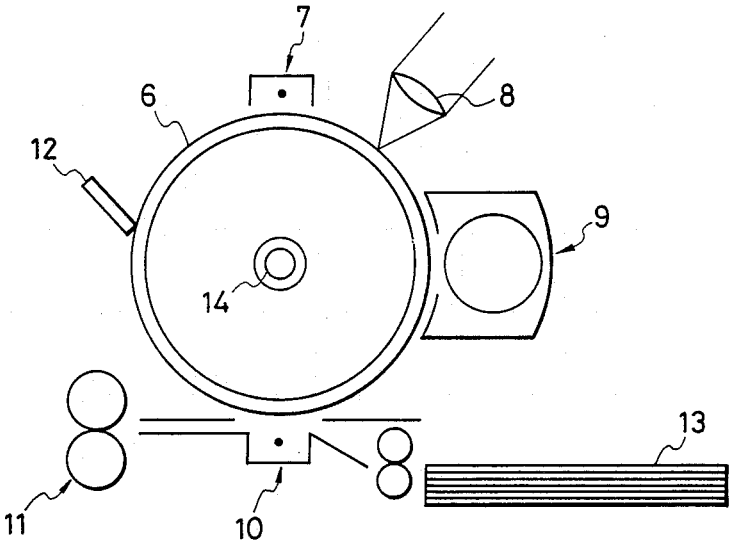
FIG. 4 is a schematic drawing of an electrophotographic apparatus in which the photoreceptor of the present invention is set.

This advantageous form of electrophotographic process is hereunder described with reference to FIG. 4 which is a schematic drawing of an electrophotographic apparatus in which the photoreceptor of the present invention is set. In the FIG. 4, 6 is the photoreceptor, 7 is a charging means for providing a uniform electric field across the photoreceptor in the dark, 8 is a latent image forming means by which the illuminated original is projected through a lens system and focused on the photoreceptor to form a corresponding latent electrostatic image, 9 is a developing means for applying toner particles to render the latent image visible, 10 is a transfer means by which the developed image is transfer-red onto a receiving member, 11 is a fixing means for fixing the transferred image, 12 is a cleaning means, 13 is a receiving sheet, and 14 is a photoreceptor heating means in the form of a quartz lamp provided in a rotating shaft.

The means for heating the photoreceptor may be provided on any desired position. In FIG. 4, the heating means 14 is provided with in the shaft for rotating the photoreceptor but .if desired, it may be disposed in any suitable area around the photoreceptor as are the development, charging and transfer means. The heating means may be disposed either on the side closer to the photoconductive layer of the photoreceptor or on the side closer to its support. In the latter case, the heating means may be provided at any desired position but it is preferably in the form of a planar heater that is placed in close and uniform contact with the support for heating the photoreceptor.

Illustrative means of heating the photoreceptor are heating lamps such as a quartz lamp having a Nichrome wire in a quartz glass tube, and a planar heater that has a Nichrome wire embedded in a sheet of heat-resistant flexible rubber such as silicone rubber. Other useful heating means include a hot-air blowing heater, a device that utilizes the heat of radiation such as infrared rays, and a device that utilizes the heat generated by the fixing unit. These heating means may be-supplied with an electric current by any suitable method. If the heating means is to be disposed inward of the support of the photoreceptor (within a drum), a current is preferably supplied via a slip ring that is mounted on the photoreceptor rotating shaft.

The following examples and comparative examples are provided for the purpose of further illustrating the present invention but are in no sense to be taken as limiting.

EXAMPLE 1

Using a capacitively coupled plasma CVD apparatus capable of forming an amorphous silicon film over a cylindrical support, a mixture of a silane ($SiH_4$) gas, a hydrogen ($H_2$) gas and a diborane ($B_2H_6$) gas was decomposed by glow discharge so as to form a charge injection blocking layer about 0.5 μm thick on a cylindrical aluminum support. The process conditions were as follows:

Flow rate of 100% silane gas: 100 $cm^3$/min
Flow rate of 100 ppm $H_2$ diluted diborane gas: 200 $cm^3$/min
Pressure in the reactor: 0.5 Torr
Discharge power: 100 W
Duration of discharge: 30 min
Discharge frequency: 13.56 MHz
Support temperature: 250° C.

(In this example, as well as in subsequent Examples 2 and 3 and Comparative Examples 1 to 8 given hereunder, the discharge frequency and support temperature were fixed at the above-specified values for the formation of all layers on the support.)

After the formation of the charge injection blocking layer, the reactor was thoroughly emptied of any residual gas and charged with a mixture of silane, hydrogen and diborane gases. By glow discharge decomposition of this mixture, a photoconductive layer about 20 μm thick was formed on the blocking layer. The process conditions were as follows:

Flow rate of 100% silane gas: 200 $cm^3$/min
Flow rate of 100% hydrogen gas: 180 $cm^3$/min
Flow rate of 100 ppm diluted diborane gas: 20 $cm^3$/min
Pressure in the reactor: 1.5 Torr
Discharge power: 300 W
Duration of discharge: 240 min.

After the formation of the photoconductive layer, the reactor was thoroughly emptied of any residual gas and charged with a mixture of silane, hydrogen, and ammonia ($NH_3$) gases. By glow discharge decomposition of this mixture, a first surface layer about 0.3 μm thick was formed on the photoconductive layer. The process conditions were as follows:

Flow rate of 100% silane gas: 30 $cm^3$/min
Flow rate of 100% hydrogen gas: 200 $cm^3$/min
Flow rate of 100% ammonia gas: 30 $cm^3$/min
Pressure in the reactor: 0.5 Torr
Discharge power: 50 W
Duration of discharge: 60 min.

Compositional analysis of this surface layer showed that the ratio of the number of nitrogen atoms to that of silicon atoms was about 0.6.

After the formation of the first surface layer, the reactor was thoroughly emptied of any residual gas and charged with a mixture of silane, hydrogen and ammonia gases. By glow discharge decomposition of the mixture, a second surface layer about 0.1 μm thick was formed on the first surface layer. The process conditions were as follows:

Flow rate of 100% silane gas: 17 $cm^3$/min
Flow rate of 100% hydrogen gas: 200 $cm^3$/min
Flow rate of 100% ammonia gas: 43 $cm^3$/min
Pressure in the reactor: 0.5 Torr
Discharge power: 50 W
Duration of discharge: 20 min.

Compositional analysis of this surface layer showed that the ratio of the number of nitrogen atoms to that of silicon atoms was about 0.8.

The so fabricated photoreceptor had a charge injection blocking layer, a photoconductive layer, and a first and a second surface layer formed on the aluminum support. This photoreceptor was set in an electrophotographic copier for evaluating the quality of the images it would produce. The copier was operated under three different sets of environmental conditions; 30° C.×85% r.h., 20° C.×50% r.h., and 10° C.×15% r.h. During the operation, the drum surface was heated to about 45° C.

In the initial period of operation, the heated photoreceptor produced a sharp image under all of the three sets of environmental conditions employed. After evaluation of the initial image quality, about $2\times10^4$ copies were made at 20° C. and 50% r.h. Thereafter, the same number of copies were made under two other sets of environmental conditions, i.e., 30° C.×85% r.h. and 10° C.×15% r.h. Under all of the three sets of environmental conditions, the photoreceptor yielded $2\times10^4$ copies with good image quality.

The copies, whether they were attained in the initial period or during the $2\times10^4$ runs, had fogless high-density images that were free from any detectable defects due to surface flaws in the photoreceptor.

COMPARATIVE EXAMPLE 1

A charge injection blocking layer and a photoconductive layer were successively formed on an aluminum support using the same apparatus as employed in Example 1 and following the method and process conditions of that example.

After the formation of the photoconductive layer, the reactor was thoroughly emptied of any residual gas and charged with a mixture of silane, hydrogen and ammonia gases. By glow discharge decomposition of this mixture, a surface layer about 0.3 μm was formed on the photoconductive layer. The process conditions were as follows:

Flow rate of 100% silane gas: 17 $cm^3$/min
Flow rate of 100% hydrogen gas: 200 $cm^3$/min
Flow rate of 100% ammonia gas: 43 $cm^3$/min
Pressure in the reactor: 0.5 Torr
Discharge power: 50 W
Duration of discharge: 60 min.

Compositional analysis of this surface layer showed that the ratio of the number of nitrogen atoms to that of silicon atoms was about 0.8.

The so fabricated photoreceptor had a charge injection blocking layer, a photoconductive layer and a surface layer formed on the aluminum support. When this photoreceptor was set in a copying machine and copies made, extensive dilation occurred even in the initial period (within a few cycles to several tens of cycles) of operation.

COMPARATIVE EXAMPLE 2

A charge injection blocking layer, a photoconductive layer and a surface layer were successively on an aluminum support using the same apparatus as employed in Example 1 and following the method and process conditions of that example.

The so fabricated photoreceptor was set in a copier for making copies. In the initial period (within a few cycles to several tens of cycles of operation), sharp images were produced under all of the three environmental conditions employed. After evaluation of the initial image quality, about $2\times10^4$ copies were made at 20° C. and 50% r.h. Thereafter, the environmental conditions in which the copier was operated were changed to 30° C.×85% r.h. or 10° C.×15% r.h. and ca. $2\times10^4$ copies were made. The copies made at 20° C. and 50% r.h. had a sharp image but dilation had occurred in the copies made under the two other sets of environmental conditions.

COMPARATIVE EXAMPLE 3

The photoreceptor prepared in Comparative Example 2 was set in a copying machine for evaluating the quality of the image it would produce under the same testing conditions as used in Comparative Example 2 except that the drum surface was heated at about 45° C.

In the initial period of operation, the photoreceptor produced copies having a sharp image under all of the three sets of environmental conditions employed. After the evaluation of initial image quality, about $2\times10^4$ copies were made at 20° C. and 50% r.h. Thereafter, the environmental conditions under which the copying machine was installed were changed to 30° C.×85% r.h. or 10° C.×15% r.h. and approximately $2\times10^4$ copies were made. the copies made at 30° C. and 85% r.h. had a sharp image but dilation had occurred in the copies made under the two other sets of environmental conditions.

EXAMPLE 2

Using a capacitively coupled plasma CVD apparatus capable of forming an amorphous silicon film over a cylindrical support, a mixture of a silane ($SiH_4$) gas, a hydrogen ($H_2$) gas and a diborane ($B_2H_6$) gas was decomposed by glow discharge so as to form a charge injection blocking layer about 0.5 pm thick on a cylindrical aluminum support. The process conditions were as follows:

Flow rate of 100% silane gas: 100 $cm^3$/min
Flow rate of 100 ppm $H_2$ diluted diborane gas: 200 $cm^3$/min
Pressure in the reactor: 0.5 Torr
Discharge power: 100 W
Duration of discharge: 30 min.

After formation of the charge injection blocking layer, the reactor was thoroughly emptied of any residual gas and charged with a mixture of silane, hydrogen and diborane gases. By glow discharge decomposition of this mixture, a charge transport layer about 20 μm thick was formed on the charge injection blocking layer. The process conditions were as follows:

Flow rate of 100% silane gas: 200 $cm^3$/min
Flow rate of 100% hydrogen gas: 180 $cm^3$/min
Flow rate of 100 ppm $H_2$ diluted diborane gas: 20 $cm^3$/min
Pressure in the reactor: 1.5 Torr
Discharge pressure: 300 W
Duration of discharge: 240 min.

After formation of the charge transport layer, the reactor was thoroughly emptied of any residual gas and charged with a mixture of a silane gas, a hydrogen gas, and a germane ($GeH_4$) gas. By glow discharge decomposition of this mixture, a charge generation layer about 2 μm thick was formed on the charge transport layer. The process conditions were as follows:

Flow rate of 100% silane gas: 120 $cm^3$/min
Flow rate of 100% hydrogen gas: 150 $cm^3$/min
Flow rate of 100% germane gas: 30 $cm^3$/min
Pressure in the reactor: 1.3 Torr
Discharge power: 200 W
Duration of discharge: 30 min.

After formation of the charge generation layer, the reactor was thoroughly emptied of any residual gas and charged with a mixture of silane, hydrogen and ammonia gases. By glow discharge decomposition, a first surface layer about 0.3 μm thick was formed on the charge generation layer. The process conditions were as follows:

Flow rate of 100% silane gas: 30 $cm^3$/min
Flow rate of 100% hydrogen gas: 200 $cm^3$/min
Flow rate of 100% ammonia gas: 30 $cm^3$/min
Pressure in the reactor: 0.5 Torr
Discharge power: 50 W
Duration of discharge: 60 min Compositional analysis of this surface layer showed that the ratio of the number of nitrogen atoms to that of silicon atoms was about 0.6.

After formation of the first surface layer, the reactor was thoroughly emptied of any residual gas and charged with a mixture of silane, hydrogen and ammonia gases. By glow discharge decomposition of this mixture, a second surface layer about 0.1 μm thick was formed on the first surface layer. The process conditions were as follows:

Flow rate of 100% silane gas: 17 $cm^3$/min
Flow rate of 100% hydrogen gas: 200 $cm^3$/min
Flow rate of 100% ammonia gas: 43 $cm^3$/min
Pressure in the reactor: 0.5 Torr
Discharge power: 50 W
Duration of discharge: 20 min.

Composition analysis of this surface layer showed that the ratio of the number of nitrogen atoms to that of silicon atoms was about 0.8.

The so fabricated photoreceptor had a charge injection blocking layer, a charge transport layer, a charge generation layer, and a first and a second surface layer formed on the aluminum support. This photoreceptor was set in a semiconductor laser printer for evaluating the quality of the image it would produce. The printer was operated under three different environmental conditions: 30° C.×85% r.h., 20° C.×50% r.h., and 10° C.×15% r.h.. During the operation, the drum surface was heated to about 45° C.

In the initial period of operation, the heated photoreceptor produced a sharp image under all of the three environmental conditions employed. After evaluation of the initial image quality, about $2\times10^4$ prints were produced at 20° C. and 50% r.h. Thereafter, the environmental conditions under which the printer was installed were changed to 30° C.×85% r.h. or 10° C.×15% r.h. and it was operated for approximately $2\times10^4$ runs. Under all of the three sets of environmental conditions, the photoreceptor yielded approximately $2\times10^4$ prints having an image whose sharpness was substantially the same as attained in the initial period of operation.

The printed matter, whether it was attained in the initial period or during the $2\times10^4$ runs, had fogless high-density images that were free from any detectable defects due to surface flaws in the photoreceptor.

Evaluation of the photoreceptor was also conducted in an electrophotographic copier under three different sets of environmental conditions (30° C.×85% r.h.; 20° C.×50% r.h.; and 10° C.×15% r.h.). Under all of these conditions, the photoreceptor produced fogless high-density images having high resolution and good tone reproduction.

EXAMPLE 3

A charge injection blocking layer was formed on an aluminum support using the same apparatus as employed in Example 2 and following the method and process conditions of that example.

After formation of the charge injection blocking layer, the reactor was thoroughly emptied of any residual gas and charged with a mixture of silane, hydrogen and germane gases. By glow discharge decomposition of this mixture, a charge generation layer about 2 μm thick was formed on the charge injection blocking layer. The process conditions were the same as those employed in Example 2 for the formation of a charge generating layer.

After formation of the charge generating layer, the reactor was thoroughly emptied of any residual gas and charged with a mixture of silane, hydrogen and diborane gases. By glow discharge decomposition of this mixture, a charge transport layer about 20 μm thick was formed on the charge generation layer. The process conditions were the same as those employed in Example 2 for the formation of a charge transport layer.

Subsequent to the formation of the charge transport layer, a first and a second surface layer were successively formed on the charge transport layer employing the same method and conditions as used in Example 2.

The so fabricated photoreceptor had a charge injection blocking layer, a charge generating layer, a charge transport layer, and a first and a second surface layer formed on the aluminum support. This photoreceptor was set in a semiconductor laser printer for evaluating the quality of the image it would produce. During the operation, the drum surface was heated to 45° C.

In the initial period of operation, the heated photoreceptor produced a sharp image under all of the three sets of environmental conditions employed. After evaluation of the initial image quality, about $2\times10^4$ prints were produced at 20° C. and 50% r.h. Thereafter, the environmental conditions under which the printer was installed were changed to 30° C.×85% r.h. or 10° C.×15% r.h. and it was operated for approximately $2\times10^4$ runs. Under all of the three sets of environmental conditions, the photoreceptor yielded approximately $2\times10^4$ prints having an image whose sharpness was substantially the same as was attained in the initial period of operation.

The printed matter, whether it was attained in the initial period or during the $2\times10^4$ runs, had fogless high-density images that were free from any detectable defects due to surface flaws in the photoreceptor.

Evaluation of the photoreceptor was also conducted in an electrophotographic copier under three different sets of environmental conditions (30° C.×85% r.h.; 20° C.×50% r.h.; and 10° C.×15% r.h.). Under all of these conditions, the photoreceptor produced fogless high-density images having high resolution and good tone reproduction.

COMPARATIVE EXAMPLE 4

A charge injection blocking layer, a charge transport layer and a charge generating layer were successively formed on an aluminum support using the same apparatus as employed in Example 2 and following the method and process conditions of that example. In this comparative example, neither a first nor a second surface layer was formed.

Image quality evaluation was conducted on the so fabricated photoreceptor as it was set in a printer employing a semiconductor laser as a light source. The photoreceptor provided a sharp image in the initial period of its operation but after 1,000 runs a blurred image was produced.

COMPARATIVE 5

A charge injection blocking layer, a charge generating layer and a charge transport layer were successively formed on an aluminum support using the same apparatus as employed in Example 3 and following the method and process conditions of that example. In this comparative example, neither a first nor a second surface layer was formed.

Image quality evaluation was conducted on the so fabricated photoreceptor with it set in a printer employing a semiconductor laser as a light source. The photoreceptor provided a sharp image in the initial period of its operation but after 1,000 runs a blurred image was produced.

COMPARATIVE EXAMPLE 6

A charge injection blocking layer, a charge transport layer and a charge generating layer were successively formed on an aluminum support using the same apparatus as employed in Example 2 and following the method and process conditions of that example.

After formation of the charge generation layer, the reactor was thoroughly emptied of any residual gas and charged with a mixture of silane, hydrogen and ammonia gases. By glow discharge decomposition of this mixture, a surface layer about 0.3 μm thick was formed on the charge generation layer. The process conditions were as follows:

Flow rate of 100% silane gas: 17 $cm^3$/min
Flow rate of 100% hydrogen gas: 200 $cm^3$/min
Flow rate of 100% ammonia gas: 43 $cm^3$/min
Pressure in the reactor: 0.5 Torr
Discharge power: 50 W
Duration of discharge: 60 min.

Compositional analysis of this surface layer showed that the ratio of the number of nitrogen atoms to that of silicon atoms was about 0.8.

The so fabricated photoreceptor had a charge injection blocking layer, a charge transport layer, a charge generating layer and a surface layer formed on the aluminum support. When this photoreceptor was set in a semiconductor laser printer and prints produced, extensive dilation occurred even in the initial period (within a few cycles to several tens of cycles) of operation.

COMPARATIVE EXAMPLE 7

A charge injection blocking layer, a charge transport layer, a charge generating layer, and a first surface layer were successively formed on an aluminum support using the same apparatus as employed in Example 2 and following the method and process conditions of that example. In this comparative example, no second surface layer was formed.

The so fabricated photoreceptor was set in a semiconductor laser printer and a printing test was conducted in order to evaluate the quality of the image produced under three different sets of environmental conditions (30° C.×85% r.h.; 20° C.×50% r.h.; 10° C.×15% r.h.). In the initial period of operation, the photoreceptor produced a sharp image under al of the three sets of environmental conditions. After evaluation of the initial image quality, about $2\times10^4$ prints were produced at 20° C. and 50% r.h. Thereafter, the environmental conditions under which the printer was installed were changed to 30° C.×85% r.h. or 10° C.×15% r.h. and approximately $2\times10^4$ prints were produced. The prints obtained and 20° C. and 50% r.h. were as good as those produced in the initial period in such terms as resolution, image density and fog. However, dilation occurred under the two other sets of environmental conditions.

COMPARATIVE EXAMPLE 8

The photoreceptor prepared in Comparative Example 7 was set in a semiconductor laser printer for evaluating the quality of the image it would produce under the same testing conditions as used in Comparative Example 7 except that the drum surface was heated to about 45° C.

In the initial period of operation, the photoreceptor produced prints having a sharp image under all of the three sets of environmental conditions employed. After the evaluation of initial image quality, about $2\times10^4$ prints were made at 20° C. and 50% r.h. Thereafter, the environmental conditions under which the printer was installed were changed to 30° C.×85% r.h. or 10° C.×15% r.h. and approximately $2\times10^4$ prints were made. The copies made at 30° C. and 85% r.h. had a sharp image but dilation had occurred in the copies made under the two other sets of environmental conditions.

Having the structure described hereinabove, the electrophotographic photoreceptor of the present invention has the following advantages: it produces an initial image of high quality and exhibits a higher time-dependent stability and a longer run than conventional products; it retains high photosensitivity over the full spectrum range of visible light and up to the near-infrared region in which semiconductor lasers are designed to operate; it has a high dark resistivity and enables efficient initial charging; and its characteristics depend little on the environment in which it is used.

Because of these advantages, the photoreceptor of the present invention is capable of duplicating images having high resolution and good tone reproduction. The images are fogless and retain high density whether they are produced in the initial period or after many cycles of operation.

Particularly good results can be attained from the photoreceptor of the present invention when it is used in an electrophotographic process that involves its being heated to a surface temperature of at least 35°–50° C. In such a process, the photoreceptor will produce a stable and high-quality initial image under any environmental conditions without experiencing any image deterioration as a result of cyclic use.

What is claimed is:

1. An electrophotographic photoreceptor comprising:

a photoconductor layer substantially composed of amorphous silicon;

a first surface layer having a first thickness, disposed to cover said photoconductive layer, substantially composed of a mixture of amorphous silicon and nitrogen atoms, said nitrogen atoms having a first predetermined concentration which is homogenous across the thickness of said first layer;

a second surface layer having a second thickness, disposed to cover said first layer, substantially composed of a mixture of amorphous silicon and nitrogen atoms, said nitrogen atoms having a second predetermined concentration which is greater than said first predetermined concentration and is homogenous across the thickness of said second layer.

2. An electrophotographic photoreceptor according to claim 1, wherein said photoconductive layer contains atoms of an element of group III in an amount of 0.1–100 ppm.

3. An electrophotographic photoreceptor according to clam 1 or 2, further comprising a charge injection blocking layer between said support and said photoconductive layer

4. An electrophotographic photoreceptor according to claim 3 wherein said charge injection blocking layer is made of amorphous silicon that is doped with atoms of an element of group III or V in an amount of 10–5,000 ppm.

5. An electrophotographic photoreceptor according to claim 1, wherein at least a part of said photoconductive layer is doped with germanium atoms.

6. An electrophotographic photoreceptor according to claim 5, wherein said photoconductive layer has a dual structure composed of a charge generation layer and a charge transport layer, said charge generation being substantially made of amorphous silicon that is doped with germanium atoms, and said charge transport layer being substantially made of amorphous silicon that is doped with atoms of an element of group III.

7. An electrophotographic photoreceptor according to claim 5 or 6, further comprising a charge injection blocking layer between said support and said photoconductive layer.

8. An electrophotographic photoreceptor according to claim 7, wherein said charge injection blocking layer is made of amorphous silicon that is doped with atoms of an element of group III or V in an amount of 10–5,000 ppm.

9. An electrophotographic photoreceptor according to claim 6, wherein the concentration of said gerumanium atoms is within the range of 0.1–1.5 in terms of the ratio of the number of germanium atoms to that of silicon atoms.

10. An electrophotographic photoreceptor according to claim 6, wherein the amount of said element of group III is 0.1–100 ppm.

11. An electrophotographic photoreceptor according to any one of the preceding claims 1 and 2 to 10, wherein said photoreceptor is used in an electrophotographic process that involves the heating of said photoreceptor to at least a surface temperature of 35°–50° C.

12. An electrophotographic photoreceptor according to claim 1, wherein the concentrations of nitrogen atoms in said first and second surface layers are within the range of 0.1–1.0 and within the range of 0.5–1.3 in terms of the ratio of the number of nitrogen atoms to that of silicon atoms in said first and second surface layers, respectively.

13. An electrophotographic photoreceptor according to claim 12, wherein the thicknesses of said first and second surface layers are within 0.01–5 μm, respectively.

* * * * *

UNITED STATES PATENT AND TRADEMARK OFFICE

CERTIFICATE OF CORRECTION

PATENT NO. : 4,965,154

DATED : October 23, 1990

INVENTOR(S) : Kenichi Karakida et al.

It is certified that error appears in the above-identified patent and that said Letters Patent is hereby corrected as shown below:

Claim 1, Column 12, Line 26, "photoconductor" should be --photoconductive--.

Signed and Sealed this

Twenty-ninth Day of September, 1992

*Attest:*

DOUGLAS B. COMER

*Attesting Officer*

*Acting Commissioner of Patents and Trademarks*